United States Patent [19]

Lang

[11] Patent Number: 4,617,027

[45] Date of Patent: Oct. 14, 1986

[54] GASIFICATION PROCESS

[75] Inventor: Robert J. Lang, Baytown, Tex.

[73] Assignee: Exxon Research and Engineering Co., Florham Park, N.J.

[21] Appl. No.: 408,990

[22] Filed: Aug. 17, 1982

Related U.S. Application Data

[63] Continuation of Ser. No. 861,825, Dec. 19, 1977, abandoned.

[51] Int. Cl.[4] ..... C10J 3/14

[52] U.S. Cl. ..... 48/210; 48/202

[58] Field of Search ..... 48/202, 206, 210; 252/373, 179; 423/157, 181, 432

[56] References Cited

U.S. PATENT DOCUMENTS 2,693,452 11/1904 Goedkoop ..... 252/179

4,092,125 5/1978 Stambaugh et al. ..... 48/210

OTHER PUBLICATIONS

"A Novel Approach to Gasification of Coal Using Chemically Incorporated Catalysts", Chauhran et al., 173rd ACS Mat's Meeting, 3/20-25/27, 1977.

"The Use of Catalysts in Coal Gasification", Johnson, Catal. Rev., Sci. Engr. 14(1), 1976, pp. 131-137, 142-148.

Ion Exchange, Helferich, pp. 5, 6, 17, 1962.

*Primary Examiner*—Peter Kratz

*Attorney, Agent, or Firm*—Yale S. Finkle; Wayne Hoover

[57] ABSTRACT

A novel process, and the articles of manufacture, or compositions, formed thereby, wherein a Group II-A metal, or compound thereof, can be ion-exchanged onto coal, and thereafter a Group I metal physically admixed or otherwise incorporated therewith, so that the composition can be pyrolyzed, and gasified, to form a high-BTU, intermediate-BTU or synthesis fuel gas. Suitably, the Group II metal, or alkaline earth metal, can be directly ion-exchanged onto a low rank coal, without necessity of any pretreatment, by contact with a basic solution of a Group II-A metal compound since, of course, low rank coals contain natural ion-exchange sites. An alkaline earth metal, or metals, can also be ion-exchanged onto a high rank coal, notably one deficient in natural active exchange sites, such as a subbituminous or bituminous coal, by (a) contacting, heating and soaking the coal in an alkali solution of a Group I-A metal compound sufficient to incorporate said metal compound, or cation portion thereof, into said coal and form ion-exchange sites, (b) or by oxidation of the high rank coal by contact with an oxidizing agent, preferably an oxygen-containing gas (air), peroxygen compound, oxidizing acid or the like, to form ion-exchange sites, ion-exchanging a Group II metal onto the active sites thus created, and thereafter admixing or otherwise incorporating the Group I metal to form the desired article of manufacture, or composition.

1 Claim, 1 Drawing Figure

FIGURE
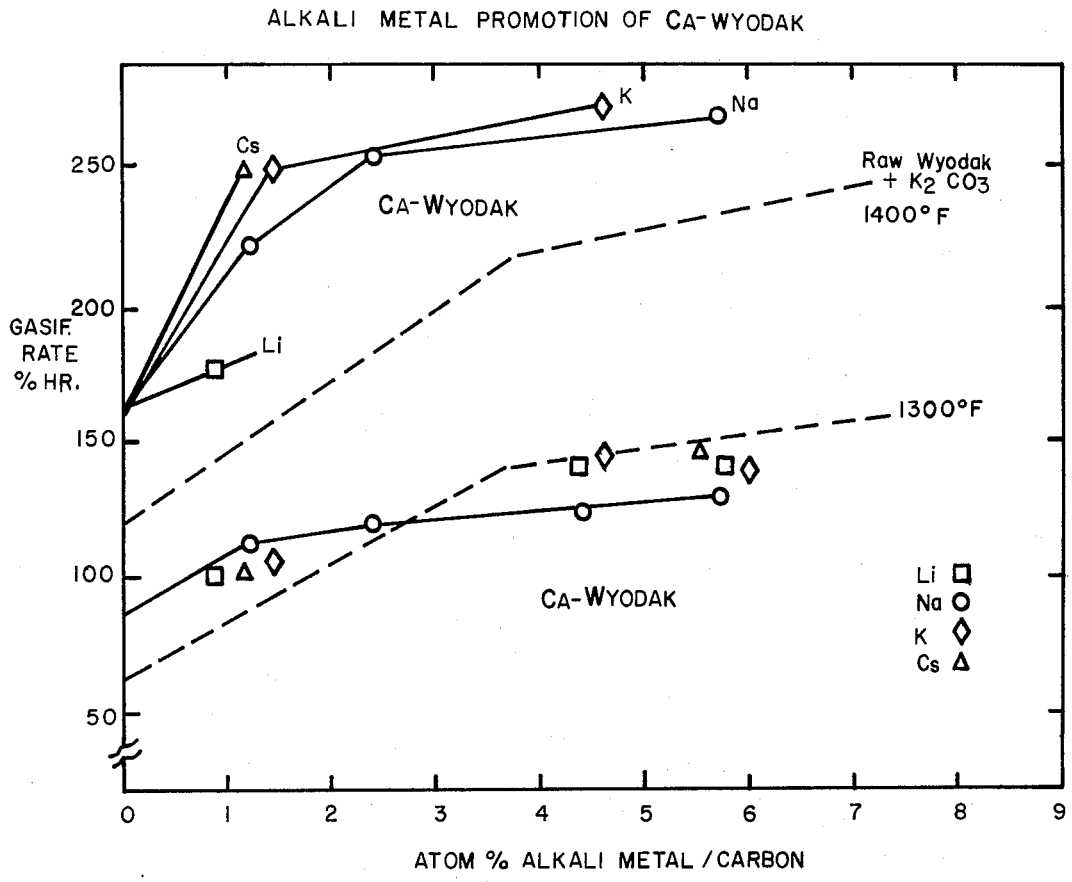

GASIFICATION PROCESS

This is a continuation of application Ser. No. 861,825, filed 12/19/77 now abandoned.

Before the turn of the century it was known that hydrocarbon gases and liquids, tars and chemicals could be obtained not only from petroleum, but from coal and other carbonaceous solids. Very early processes employed destructive distillation, coal being transformed into gases and petroleum-like liquid products. Primary emphasis in many of these processes is on gasification of the coal with the objective of improving processes for the production of water gas, producer gas, or hydrogen, as opposed to the production of coal liquids. For the past several decades, due to disallocations of supplies, there have been reoccuring periods of interest in the gasification of coal to produce fuel gases, first primarily in Europe; and then, in this country. The art reflects the various periods of interest in terms of peaks defined by large numbers of patents, and literature. Presently existing and projected shortages of natural gas in this country have sparked a renewed and very keen interest in the gasification of coal, and it appears that this will be a long-range trend. Consequently, intensive research and development efforts are now underway to produce synthetic high-BTU, intermediate-BTU and synthesis fuel gases for commercial usages.

It was early recognized that some mineral and trace inorganic constituents naturally present in some coal could exert favorable catalytic influences in gasification reactions vis-a-vis thermal reactions, and a variety of catalytic materials have been added to coal to alter the natural chemistry inherent in various of the early coal gasification processes. The thrust of present research is to develop processes for the production of synthetic high-BTU gases with far higher efficiencies than was possible in the classical European, or early Euro-American processes. There are, however, inherent chemical kinetic limitations in coal gasification processes which have defied solution, and these problems are yet unsolved. Yet, solution is essential, and there remains a strong interest in providing better coal gasification processes, or catalysts for use in catalytic coal gasification processes.

There is a profusion of information covering catalytic coal gasification processes; both domestic and foreign, this including both patents and literature. Illustrative thereof is a recent paper by James L. Johnson; Catal. Rev. Sci. Eng., 14(1) pp. 131–152 (1976), which includes a survey of the catalytic gasification art. Therein various materials have been characterized as generally useful catalysts for the gasification of coal, or carbonaceous solids, the survey naming various metals, metal oxides, metal halides, transition metals, and iron carbonyls. Group I and Group II metal compounds as a class, notably potassium carbonate, sodium carbonate, potassium chloride, sodium chloride, and calcium oxide are given special recognition, it being suggested that few catalysts are as effective in promoting gasification rates as alkali metals, and that none are more active. In the article, the catalytic properties of sodium and calcium are specifically discussed. Each of these cations, respectively, have been ion-exchanged into lignite, exchange being possible, and attributed to the presence of the carboxy functional groups known to be present in lignite, and other low rank coal structures. Gasification rates with steam-hydrogen mixtures were increased when sodium or calcium were added to the lignite via the exchange mechanism. However, attempts to add sodium or calcium to bituminous coals via ion-exchange were unsuccessful due, as suggested in the article, to the lack of exchange sites on high rank coals.

In a catalytic coal gasification process, i.e., one whose object is to produce high-BTU gas, steam, and particulate coal are fed to a gasifier at elevated temperature and pressure and converted to a synthesis gas, or gaseous mixture of high methane content, which contains significant amounts of carbon monoxide and hydrogen which must also be catalytically converted in situ or ex situ within the gasifier to methane. Practical objectives require increased thermal efficiencies, with simultaneous reduction of reactor size and temperature, as well as simplification and reduction of the steps involved in the operation. It has been recognized, and is evident that these and other objectives might be obtainable by improved catalytic materials added to the mass of feed coal. Though much of the prior art disclosures relate to disclosures of physical admixtures of a catalyst and a coal, it has been recognized that a thorough dispersion of the catalyst throughout the coal better promotes gasification rates, and activity than a physical mixture. In the past, however, whereas it has not proven particularly difficult to effectively, uniformly, disperse catalytic materials throughout low rank coal structures, this has not been true of high rank coals, notably subbituminous and bituminous coals. This is because low rank coals have active sites which makes feasible the exchange of cations onto these sites. With high rank coals, however, the coal particle is devoid of such sites.

Nonetheless it has been recognized, and disclosed in pending Application Ser. No. 812,032, filed July 1, 1977, by Richard C. Neavel and Robert J. Lang, herewith incorporated by reference, that even high rank coals can be subjected to partial oxidation to generate active exchange sites, and the oxidized coal then ion-exchanged with a suitable metal cation to improve catalytic performance in the overall gasification process. The data presented therein shows that the gasification rate of bituminous coal is increased with increased concentrations of either the alkali metal, or alkaline earth metal cations present in the coal structure. Though the alkali metal cations, notably potassium, are shown the most active, it is also shown that calcium, which is relatively inactive when incorporated as a physical mixture with coal, becomes quite active catalytically when incorporated with the coal via ion-exchange. Moreover, even the catalytic activity of the alkali metals are further improved when ion-exchanged into the coal as contrasted with physical admixture of same with the coal.

A process is also disclosed in Application Ser. No. 861,824, filed Dec. 19, 1977 by Richard C. Neavel wherein it is suggested that Group II-A metals, or compounds thereof, can be ion-exchanged onto coal, preferably a high rank coal, notably a subbituminous or bituminous coal, by soaking the coal in an alkali solution of a Group I-A metal compound sufficient to incorporate said metal compound, or cation portion thereof, into said coal to form ion-exchange sites, and all or a portion, preferably a portion, of the Group I-A metal cations then ion-exchanged, and replaced with said Group II-A metals. The coal, which contains both the Group I-A and Group II-A metals, constitutes a feed composition which can be gasified at rates far greater than compositions otherwise similar except that they contain an equal molar quantity of either a Group I-A metal or Group II-A metal, rather than both metals.

It has also been reported by Batelle Memorial Institute, subsequent to this invention, that "Batelle-treated coal" has been prepared from a high rank coal, i.e., Pittsburgh No. 8 coal in Batelle Memorial Institute's Hydrothermal Coal process by treating in aqueous sodium hydroxide/calcium oxide (CaO) solution (0.13:1 CaO to coal) at 250° C. (480° F.), up to 3% of the CaO being chemisorbed on the coal. It is disclosed that at 850° C. (1560° F.) and 500 psig 65% of the treated coal can be converted by steam in three minutes compared with 90 minutes for untreated coal. S. P. Chauhan (Batelle Memorial Institute, Columbus Lab), K. Woodcock (E.R.D.A.) et al 173rd ACS National Meeting (New Orleans 3/20-25/77) ACS Div. Fuel Chem. Prepr. 22 #1:38-52 (1977).

There is, and remains a crying need for providing better catalytic coal gasification processes, or catalysts for use in catalytic coal gasification processes which are capable of producing high-BTU fuel gases from various coals, particularly high rank coals for commercial usages at improved economies, or efficiencies.

It is, accordingly, the primary objective of the present invention to supply this need.

A particular object is to provide a process for the treatment of coals, notably high rank coals, or coals which have insufficient active sites to permit ion-exchange, to render such coals amenable to gasification at increased rate, particularly for use in the production of high-BTU fuel gases.

A more particular object of the invention is to provide a process of such character wherein bituminous coals can be converted into a highly active feedstock for use in coal gasification reactions, especially for the production of high-BTU fuel gases.

A further object is to provide, as compositions or articles of manufacture, a pretreated particulate coal feed which has been rendered amenable to gasification by treating to form therein relatively inexpensive species of Group I-A or Group II-A metals, or admixtures thereof, in high concentrations.

These objects and others are achieved in accordance with the present invention embodying a novel process, and the articles of manufacture, or compositions, formed thereby, wherein a Group II-A metal, or compound thereof, can be ion-exchanged onto coal, and thereafter a Group I metal admixed or otherwise incorporated therewith, so that the composition can be pyrolyzed, and gasified, to form a high-BTU, intermediate-BTU, or synthesis fuel gas. Suitably, the Group II metal, or alkaline earth metal, can be directly ion-exchanged onto a low rank coal, without necessity of any pretreatment, by contact with a solution of a Group II-A metal compound, preferably a basic solution of said compound; since, of course, low rank coals contain natural ion-exchange sites. An alkaline earth metal, or metals, can also be ion-exchanged onto a high rank coal, notably one deficient in natural active exchange sites, such as a subbituminous or bituminous coal, by (a) contacting and soaking the coal in an alkali solution of a Group I-A metal compound sufficient to incorporate said metal compound, or cation portion thereof, into said coal and form ion-exchange sites, (b) or by oxidation of the high rank coal by contact with an oxidizing agent, preferably an oxygen-containing gas (air), peroxygen compound, oxidizing acid or the like, to form ion-exchange sites, ion-exchanging a Group II-A metal onto the active sites thus created, and thereafter admixing or otherwise incorporating a Group I metal, or alkali metal, therewith to form the desired article of manufacture, or composition. The composition can be pyrolyzed, and gasified, to form a high-BTU, intermediate-BTU or synthesis fuel gas. Enhanced gasification rates are achieved by gasification of the so-treated coal, or composition which contains both the Group II-A and Group I-A metals, as contrasted with a composition otherwise similar except that it contains an equal molar quantity of either a Group II-A metal or Group I-A metal, rather than both metals.

It is essential initially to incorporate a Group II-A metal, or metals, onto a coal via ion-exchange. This is conveniently accomplished with low rank coals, or coals which have adequate ion-exchange sites, by contacting and soaking the coal, suitably in particulate form, in a dispersion, or solution of a Group II-A metal compound, preferably an aqueous hydroxide solution containing sufficient of the Group II-A metal compound to exchange all the available sites and impart from about 0.1 to about 10 atomic percent, preferably from about 1 to about 8 atomic percent, of the Group II-A metal onto the coal, based on the carbon present in the char after it is pyrolyzed and devolatilized. Suitably, the treatment is conducted at temperatures ranging from about 20° F. to about 230° F., preferably from about 40° F. to about 90° F., suitably for periods ranging at least about 1 hour, preferably from about 1 hour to about 72 hours, more preferably from about 24 hours to about 48 hours, when the temperature of the solution is maintained within the expressed preferred ranges. The period of contact, or soak, is not critical, and lesser soak periods can be employed as coal particle size is decreased.

High rank coals, though lacking in natural ion-exchange capacity (compared to low rank coals), to permit substantial direct ion-exchange of a Group II-A metal onto the coal, can also be treated to form Group II-A metal ion-exchangeable sites, or sites on which Group II-A metal cations can be exchanged. In one embodiment, a high rank coal is treated with a solution of a Group I-A metal compound to form the necessary sites necessary for exchange therewith of Group II-A cations. Suitably, in accordance therewith, a particulate coal containing less oxygen in an active form than would be required to impart from about 2 to about 10 wt. percent calcium ion is contacted and soaked in an alkali solution of a Group I-A metal compound, or compounds, preferably an aqueous alkali hydroxide of from about 0.1 molarity to about 10 molarity, more preferably from about 0.5 molarity to about 2 molarity, at conditions sufficient to form active sites onto which can be exchanged between about $5\times10^{-4}$ to about $8\times10^{-3}$ gram atom equivalents of a Group I-A metal, preferably from about $1\times10^{-3}$ to about $5\times10^{-3}$ gram atom equivalents of a Group I-A metal. Suitably, the treatment is conducted at temperatures ranging from about 20° F. to about 250° F., preferably from about 180° F. to about 220° F., suitably for periods ranging at least about 0.1 hour, preferably from about 0.25 hour to about 6 hours, more preferably from about 0.25 hour to about 1 hour, when the temperature of the solution is maintained within the expressed preferred ranges. The period of contact, or soak, is variable and lesser soak periods can be employed as temperatures are increased.

Group II-A cation exchangable sites can also be formed in high rank coals by partial oxidation of the coal as described in Application Ser. No. 812,032, supra. In accordance therewith, particulate coals are oxidized by contact with an oxygen-containing gas (air) peroxygen compounds inorganic or organic peroxides, oxidizing acids and the like. Exemplary of such compounds are hydrogen peroxide, organic and metal peroxides, alkali metal permanganates, hypochlorite, nitric acid, sulfuric acid and the like. The coal within which Group II-A cation exchangeable sites have been created is then contacted and soaked with a solution, dispersion or slurry, preferably an aqueous solution of from about $1\times10^{-6}$ molarity to about 5 molarity, preferably from about $1\times10^{-2}$ molarity to about 2 molarity, of a Group II-A metal compound, or compounds, sufficient to exchange Group II metal cations into the structure. Solution temperatures ranging from about 20° F. to about 230° F., preferably from about 40° F. to about 90° F., are satisfactory for ion-exchange of Group II-A metal cations into the structure. The period of treatment generally requires at least about 1 hour, suitably from about 1 hour to about 72 hours, and preferably from about 24 hours to about 48 hours for adequate exchange at the preferred conditions.

Formation of the composition suitable for pyrolysis, or gasification, is then completed by physical incorporation, or admixture, of the Group I-A metal compound with the Group II-A containing coal. In forming the novel compositions, or articles of manufacture, of this invention, suitably from about 0.1 atomic percent to about 10 atomic percent, preferably from about 0.5 atomic percent to about 3 atomic percent, of the Group I-A metal, or metals, based on the carbon present in the coal char formed by pyrolysis or devolatilization is incorporated with the Group II-A ion-exchanged coal. The composition is thus one which contains, after treatment, a sum-total of from about 0.2 atomic percent to about 20 atomic percent, preferably from about 1.5 atomic percent to about 11 atomic percent, of Group II-A and Group I-A metals, based on carbon present in the coal char formed by pyrolysis or devolatilization.

The process of this invention is generally applicable for the inclusion of Group II-A and Group I-A metals in virtually any type of coal, including low rank coals such as lignite, brown coal, peat, and subbituminous and bituminous coals such as Wyodak, Illinois No. 6 Pittsburgh No. 8 and the like.

Suitable Group II-A metals, or alkaline earth metals, suitable for the practice of this invention are exemplified by magnesium, calcium, strontium and barium, the effectiveness of which for gasification purposes increases directly with increasing atomic weight except for calcium which is a highly preferred species of Group II metal based on its cost effectiveness, and exceptional reactivity. The alkaline earth metals are suitably employed in solution as salts, preferably as weak acids, and hydroxides illustrative of which are magnesium carbonate, calcium hydroxide, strontium oxalate, barium acetate and the like. Suitable Group I-A metals, or alkali metals, are exemplified by lithium, sodium, potassium, rubidium and cesium, the effectiveness of the metals as gasification catalysts increasing in direct proportion to their increased atomic weight, though sodium and potassium are preferred metals based on cost-effectiveness. These are suitably employed as salts or hydroxides, e.g., sodium carbonate, potassium hydroxide, potassium nitrate, cesium acetate and the like.

In the past, low rank coals have been successfully treated via ion-exchange with alkali or alkaline earth metal cations, including, e.g., sodium or calcium, because of natural exchange sites. The exchange of alkali or alkaline earth metal cations, particularly the latter, into bituminous coals, however, has been ineffective because of the nature of bituminous coals which are lacking in natural exchange sites compared to lower rank coals. In accordance with the present process, nontheless, ion-exchange sites are created in the coal by oxidation of the coal, or treatment with an alkali solution of Group I-A metal compounds, this making feasible the addition, or incorporation of considerably greater amounts of catalytic alkaline earth metal cations into the coal than heretofore believed possible.

Gasification processes as generally known in the art can be improved with respect to yield or conversion rate, or both, when the process of this invention is employed in the formation of the novel feed compositions. The compositions are reacted with a gaseous species or a mixture of gaseous species at elevated temperatures, and generally elevated pressures to produce and optimize the composition of the fuel gases. The gaseous species generally employed as reactants include oxygen, steam, hydrogen, and carbon oxides such as carbon dioxide. Generally, temperature, pressure, flow rate, mole ratios and relative mole ratios depend on the specific process employed and the actual products desired therefrom. In any event, the composition of the gaseous products are altered by the particular catalyst employed. For example, the products resulting from the gasification of coal with steam is enriched in methane by judicious selection of the optimum alkali and alkaline earth metal, and concentrations thereof within the feed composition, to promote the conversion of carbon monoxide and hydrogen to methane. Generally sodium or potassium in relatively high concentration are most preferred when maximum methane production from gasification by steam is desired, and calcium in high concentration is most preferred when production of carbon monoxide and hydrogen by steam gasification is desired. Gasification is generally accomplished by contacting the treated coal composition with steam at a temperature within the range from about 750° F. to about 1850° F. at a steam flow rate within the range from about 0.1 to about 60 W/W/Hr based on carbon present. Pressure is critical for product selectivity, and generally ranges from about 0 to about 1000 psig.

It has been demonstrated that alkaline earth metals will catalyze the steam gasification of coal if the metal is distributed into the coal structure by ion-exchange. Also, as shown by Neavel, the further addition of alkali metals to the alkaline earth metal exchanged coal further promotes the catalytic activity, the sum-total effect of the composite of the two types of metal being greater than can be attributed to the presence of either of the metals per se. In accordance with the present invention, however, considerable benefit can also be achieved by incorporation of the two types of metal onto a coal, the alkaline earth metal via ion-exchange and the alkali metal by mere physical incorporation which, not only offers increased gasification rates and improved methanation activity, but also offers further simplification of the process, and article of manufacture, or compositions, formed thereby.

These and other features of the present invention will be better understood by reference to the following demonstrations which involve treatment of coals with Group II-A and Group I-A metals, and runs conducted by gasification of the coal with and without benefit of treatment with the alkaline earth and alkali metal compounds and salts, particularly with reference to comparative data showing gasification of coal pretreated with both alkali and alkaline earth metal compounds and salts in accordance with this invention. All units are in terms of weight unless otherwise specified.

EXAMPLES 1-3

Samples of three low rank coals, Wyodak, Arkansas lignite and Beulah lignite, respectively, were individually treated with portions of an alkaline earth metal and with an alkali metal, respectively, and with a combination of both of these metals. In treating a coal specimen with the alkaline earth metal, the coal was contacted with a saturated aqueous solution of calcium hydroxide and the treatment continued at ambient conditions until the maximum amount, which was in the range of 7-11 wt. percent calcium, had been exchanged onto the coal. In one demonstration, a portion of Wyodak coal was treated with acetic acid (HAC) to remove any natural alkali or alkaline earth metal, while in others the coal was raw, or untreated. Sodium or potassium, respectively, in the weight proportions indicated in Table I, was physically admixed with the treated or untreated coal specimens and in some cases, water was also added. The various specimens were then pyrolyzed at 1400° F. and the char subjected to steam gasification at essentially identical conditions, averaging 7.5 grams of steam per gram of carbon, per hour, at 1300° F. and 1400° F., respectively, with the following results:

TABLE I

| | Gasification Rate-%/Hr (Avg. for 0-90% Carbon Conversion) | |
|---|---|---|
| | 1300° F. | 1400° F. |
| Wyodak + 10% $K_2CO_3$ | 140 | 218 |
| Ca-Kyodak + 5% $Na_2CO_3$ | 119 | 255 |
| Wyodak + 5% $K_2CO_3$ | 107 | 223 |
| Ca-Wyodak | 87 | 161 |
| Wyodak + 5% $Na_2CO_3$ | 86 | 226 |
| HAc-Wyodak + 5% $Na_2CO_3$ | 63 | 113 |
| Raw-Wyodak | 63 | 119 |
| Ca-Ark. Lig. + 5% $Na_2CO_3$ | 143 | 243 |
| Arkansas Lignite | 92 | 190 |
| Ca-Ark. Lig. | 83 | 163 |
| Ark. Lig. + 5% $Na_2CO_3$ | 62 | 130 |
| Beulah Lig. + 5% $Na_2CO_3$ | 126 | 180 |
| Ca-Beulah + 5% $Na_2CO_3$ | 97 | 191 |
| Beulah Lignite | 84 | 160 |
| Ca-Beulah | 62 | 141 |

These data clearly show that the three coals behave differently. Sodium and calcium individually and in combination, promote the activity of raw Wyodak coal. With Arkansas lignite, however, sodium and calcium, individually, decrease the gasification rate. The combination of both sodium and calcium, however, increases the gasification rate of the raw coal, and this is true regardless of the temperature. These data clearly shown synergism between the sodium-calcium combination. With Beulah (North Dakota) lignite, calcium alone hurts the gasification rate compared to the raw coal. Sodium alone is a better catalyst than the sodium-calcium combination at 1300° F., but not at 1400° F.

The attached FIGURE shows diagramatically the promotional effects of various alkali metals on calcium-exchanged Wyodak coal containing about 8% Ca. The alkali metals were added as carbonates before pyrolysis. The broken curves, for comparison, show the gasification rates measured with $K_2CO_3$ on raw Wyodak coal containing about 1% naturally occurring Ca. The promotional effects are seen at 1300° F. at low alkali metal loadings. The promotional effects are seen at 1400° F., with Na, K and Cs, over a wider range of loadings, and the effects are more pronounced. It will be particularly observed that inexpensive Na compares very favorably with K in its promotional effect on gasification rate.

The following example demonstrates that the methanation activity of the sodium-calcium catalyst is better than that of a coal which contain calcium alone, and its performance is not surpassed even by potassium carbonate, a known outstanding catalyst with high commercial potential.

EXAMPLE 4

A sample of Illinois No. 6 coal was oxidized by treatment at 70°-96° F. by soaking in a 3 wt. percent aqueous hydrogen peroxide solution, until the heat released indicated 2 wt.% of the carbon had been oxidized. This oxidized coal was soaked in saturated $Ca(OH)_2$ solution until the maximum amount of calcium ion was taken up by ion exchange. This material was dried and split into two portions. One portion was pyrolyzed at 1400° F., the resulting char containing 2.4 atomic % Ca/carbon. The other portion was admixed with $Na_2CO_3$ before pyrolysis at 1400° F. so that the resulting char contained 0.9 atomic % Na/carbon in addition to the calcium. Measurement was made of the amount of methane produced at different levels of conversion of the coal with steam. The results are given in Table II.

TABLE II

| Percent Steam Conversion | Gaseous Carbon as Methane, Mole % |
|---|---|
| Potassium Alone | |
| 24 | 7 |
| 44 | 17 |
| 49 | 24 |
| Calcium Plus Sodium | |
| 26 | 13 |
| 29 | 14 |
| 32 | 16 |

These data show that the methane production of the sodium-calcium combination is at least as good as with potassium carbonate at a given steam conversion.

The alkali-promoted alkaline earth catalysts are believed as effective with coal-derived products such as liquefaction bottoms and also with other gasifying agents such as hydrogen and carbon dioxide.

EXAMPLES 5-9

In a further series of runs, to show the effect of different alkaline earth metals on coal for use in forming the compositions of this invention for gasification, the maximum amount that would be taken up of various alkaline earth metals (i.e., 7.8 wt.% Ca or equivalent quantities of the others) were ion-exchanged onto portions of Wyodak coal and the compositions gasified. Certain compositions were further formed by taking portions of these ion-exchanged samples and physically admixing 5 wt.% sodium carbonate therewith, and the compositions then gasified. One specimen was treated with acetic acid to remove natural ion-exchanged metals. The results are shown in Table III.

TABLE III

| Comparison of Sodium Promoted Alkaline Earth Catalysts | Gasification Rate-%/Hr. | |
|---|---|---|
| | 1300° F. | 1400° F. |
| Ca-Wyodak + 5% $Na_2CO_3$ | 119 | 225 |
| Sr-Wyodak + 5% $Na_2CO_3$ | 90 | 199 |
| Ba-Wyodak + 5% $Na_2CO_3$ | 86 | 163 |
| Mg-Wyodak + 5% $Na_2CO_3$ | 89 | 153 |
| HAc-Wyodak + 5% $Na_2CO_3$ | 63 | 113 |
| Ca-Wyodak | 87 | 161 |
| Sr-Wyodak | 73 | — |
| Ba-Wyodak | 66 | — |
| Mg-Wyodak | 27 | 64 |
| HAc-Wyodak | 8 | 15 |

These data show that ion-exchanged Mg, Ca, Sr and Ba all catalyze the steam-gasification of Wyodak coal when these specimen are compared to the specimen which has been acetic acid extracted to remove natural calcium. When 5 wt. % sodium carbonate was added to these samples, the gasification rate increased in each case. The specimens which contained both calcium and sodium provided the best results, and it is noteworthy that at 1300° F., this gasification rate of 119%/hr cannot be reached by adding sodium carbonate to raw Wyodak coal in reasonable amounts. With 10 wt. % sodium carbonate, raw Wyodak gasifies at a rate of 105%/Hr at 1300° F., and with 20% it gasifies at 109%/hr.

The promotional effects of various alkali metals on ion-exchanged Wyodak coal containing alkaline earth metals show considerably improved gasification rates. At 1300° F. the promotional effects are seen at relatively low alkali metal loadings, and at 1400° F., the effects over a wide range of loadings are even more pronounced. Methanation activity is also improved.

It is apparent that various modifications can be made without departing the spirit and scope of the invention.

Having described the invention what is claimed is:

1. A process for gasifying coal to produce a fuel gas, which comprises:

(a) ion-exchanging from about 0.1 to about 10 atomic percent, based on carbon remaining in the char produced after said coal is pyrolyzed and devolatilized, of a Group II-A metal onto said coal by contact thereof with a solution of a Group II-A metal compound at a temperature within the range from about 20° F. to about 230° F., (b) separating the Group II-A ion-exchanged coal from said solution;

(c) admixing said Group II-A ion-exchanged coal with from about 0.1 to about 10 atomic percent, based on carbon remaining in the char produced after said coal is pyrolyzed and devolatilized, of a Group I-A metal compound; and then (d) gasifying said treated coal at gasification conditions including a temperature within the range from about 750° F. to about 1850° F. in a gasification zone to produce fuel gas, wherein the Group II-A metal is calcium, the Group I-A metal compound is a sodium compound or a potassium compound, and the coal is an Arkansas lignite.

* * * * *